US011414254B2

(12) United States Patent
Latimer

(10) Patent No.: US 11,414,254 B2
(45) Date of Patent: Aug. 16, 2022

(54) HOLDING RECEPTACLE FOR EFFECTIVELY STORING ITEMS IN A REDUCED AIR ENVIRONMENT

(71) Applicant: Michael J. Latimer, Des Moines, WA (US)

(72) Inventor: Michael J. Latimer, Des Moines, WA (US)

( * ) Notice: Subject to any disclaimer, the term of this patent is extended or adjusted under 35 U.S.C. 154(b) by 0 days.

(21) Appl. No.: 17/389,250

(22) Filed: Jul. 29, 2021

(65) Prior Publication Data

US 2022/0063894 A1 Mar. 3, 2022

Related U.S. Application Data

(60) Provisional application No. 63/071,034, filed on Aug. 27, 2020.

(51) Int. Cl.

| | |
|---|---|
| ***B65D 81/20*** | (2006.01) |
| ***B44D 3/12*** | (2006.01) |
| ***B65D 25/16*** | (2006.01) |
| ***B65D 83/00*** | (2006.01) |

(52) U.S. Cl.

CPC ..... *B65D 81/2015* (2013.01); *B44D 3/12* (2013.01); *B65D 25/16* (2013.01); *B65D 83/0055* (2013.01)

(58) Field of Classification Search

CPC . B44D 3/12; F17C 2201/018; B65D 81/2015; B65D 25/16; B65D 83/0055

USPC ..... 220/723, 721, 720, 203.28, 203.01, 220/203.19; 215/11.3, 11.1; 222/394, 222/395, 400.7, 400.8

See application file for complete search history.

(56) References Cited

U.S. PATENT DOCUMENTS

| | | | | |
|---|---|---|---|---|
| 2,999,500 | A * | 9/1961 | Schurer | A61M 1/0011 604/322 |
| 3,173,573 | A | 3/1965 | Donegan | |
| 4,147,278 | A * | 4/1979 | Uhlig | B65D 83/0055 222/400.8 |
| 4,805,799 | A | 2/1989 | Robbins, III | |
| 5,176,178 | A * | 1/1993 | Schurter | F16L 55/053 138/30 |
| 5,921,426 | A * | 7/1999 | Randolph | B65D 83/0055 220/495.06 |
| 7,017,761 | B1 | 3/2006 | Kneer | |
| 9,745,111 | B2 | 8/2017 | Brisard | |
| 2006/0000733 | A1 * | 1/2006 | Albritton | A47J 41/02 206/432 |

(Continued)

*Primary Examiner* — Rafael A Ortiz
*Assistant Examiner* — Sanjidul Islam
(74) *Attorney, Agent, or Firm* — Binita J. Singh; Bold IP, PLLC

(57) ABSTRACT

A holding receptacle for effectively storing contents in a reduced air environment to retard oxidation, drying, and other issues related to air exposure. The holding receptacle comprises a body with a flexible liner integrated to the body such that the flexible liner sits within an interior portion of the body to define an interior body to act as a conduit for a content of the holding receptacle. The holding receptable also comprises of an air valve which adjusts the air within the interior portion of the body by compressing the flexible liner toward an upper end of the body. This expels excess air from an interior portion before a lid is placed over the upper end of the body to allow the contents within to be stored in an air-free environment and improving the shelf life of the contents.

18 Claims, 3 Drawing Sheets

(56) References Cited

U.S. PATENT DOCUMENTS

2014/0224808 A1 8/2014 Brisard
2018/0354701 A1* 12/2018 Avrech ..... B65D 81/2023

* cited by examiner

HOLDING RECEPTACLE FOR EFFECTIVELY STORING ITEMS IN A REDUCED AIR ENVIRONMENT

CROSS REFERENCE TO RELATED APPLICATION

This application claims benefit of U.S. Provisional Application No. 63/071,034 filed on Aug. 27, 2020, which is incorporated by reference in its entirety.

TECHNICAL FIELD

The overall field of this invention generally pertains to a device for storage of leftover paint and more specifically to a container for storing paint in an air-free environment.

BACKGROUND

Most painting projects require buying holding receptacles which are sold in particular sizes. Unfortunately, one cannot predict exactly how much would be needed for a project and get the required amount. No matter the scope of the project, paint is bought in a holding receptacle and the remaining amount is stored in the original partially full holding receptacle. Most often, the remaining paint is stored because it would be required for touch-up or to repaint a scratched or damaged wall. However, the paint usually ends up being unusable because over time it dries up or otherwise deteriorates. Generally, paint should not be stored in extreme hot or cold temperatures which causes degradation. The problem of extreme temperatures can usually be resolved by storing the paint in an area which does not experience this variation. However, holding receptacles also degrade when air is present in the container and the chemical process of oxidation can cause the paint to degrade.

Additionally, this holding receptacle may not be limited solely to paint. There are many other substances that are stored in cans or other storage containers that can be ruined or dried due to air exposure or air retained in the cans. Similar to paint cans, this degradation and drying mostly occurs after the container has been opened, is partially used, and stored for later usage. Such substances may also benefit from this invention by reducing or eliminating drying out, increasing their respective shelf lives, and maintaining their overall quality.

Several ideas have been implemented to solve the above problem of oxidation of the paint due to air present in the holding receptacle. These solutions implement numerous approaches to removing air from a storage container. However, these solutions use complicated mechanisms to allow air to escape and would add additional expense to the paint storage container. Thus, there remains a need for an economical, simple, and effective means of removing air from the paint storage container and preventing the degradation and drying out of the stored paint due to oxidation.

SUMMARY

Accordingly, the present disclosure provides an improved, more economical, simple, and effective means of removing air from paint storage containers. It is also the object of the present disclosure to provide a paint storage means that is easy to configure. Additionally, it is also the object of this present disclosure that this improved storage container can be used for storing other materials besides paint which can degrade from air exposure and thus benefit from a reduced air environment container.

The present disclosure provides a way to remove air from the holding receptacle to prevent or minimize oxidation, drying out, or other effects of retained air that can occur in the holding receptacle. The holding receptacle may generally be described as comprising a body having an upper end, a bottom end, and a side wall that define an interior compartment and together form the substance containing structure. The body of the holding receptacle can be representative of any size commonly used in the storage of paint or other relevant substances stored in storage cans that can benefit from a reduced air environment.

The holding receptacle has a flexible liner which is preferably integrally attached to an inner surface of the side wall and suspended within an interior of the body. The flexible liner has an open end and an enclosed end wherein the open end is integrally attached to the inner surface of the side and the enclosed end is suspended within the body. Collectively, the body and the flexible liner form an interior volume for containing a fill material including a liquid and or a solid material that can benefit from a reduced air environment. The holding receptacle also comprises an air valve integrated through the side wall of the body such that air may be pumped into the interior of the body. The air valve is set up to execute a function of pushing the flexible liner upward as the volume established by the body and the flexible liner is being reduced with use of the contents within, and thus advantageously and more easily reducing the air that also tends to accumulate within the interior volume and thereby increasing the shelf life of the contents stored within by reducing the oxidation, drying out, or other issues related to air exposure.

The presently disclosed holding receptacle is further described in the attached drawings and detailed description below. Thus, other advantages and aspects of this invention will become apparent.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Figure 1:
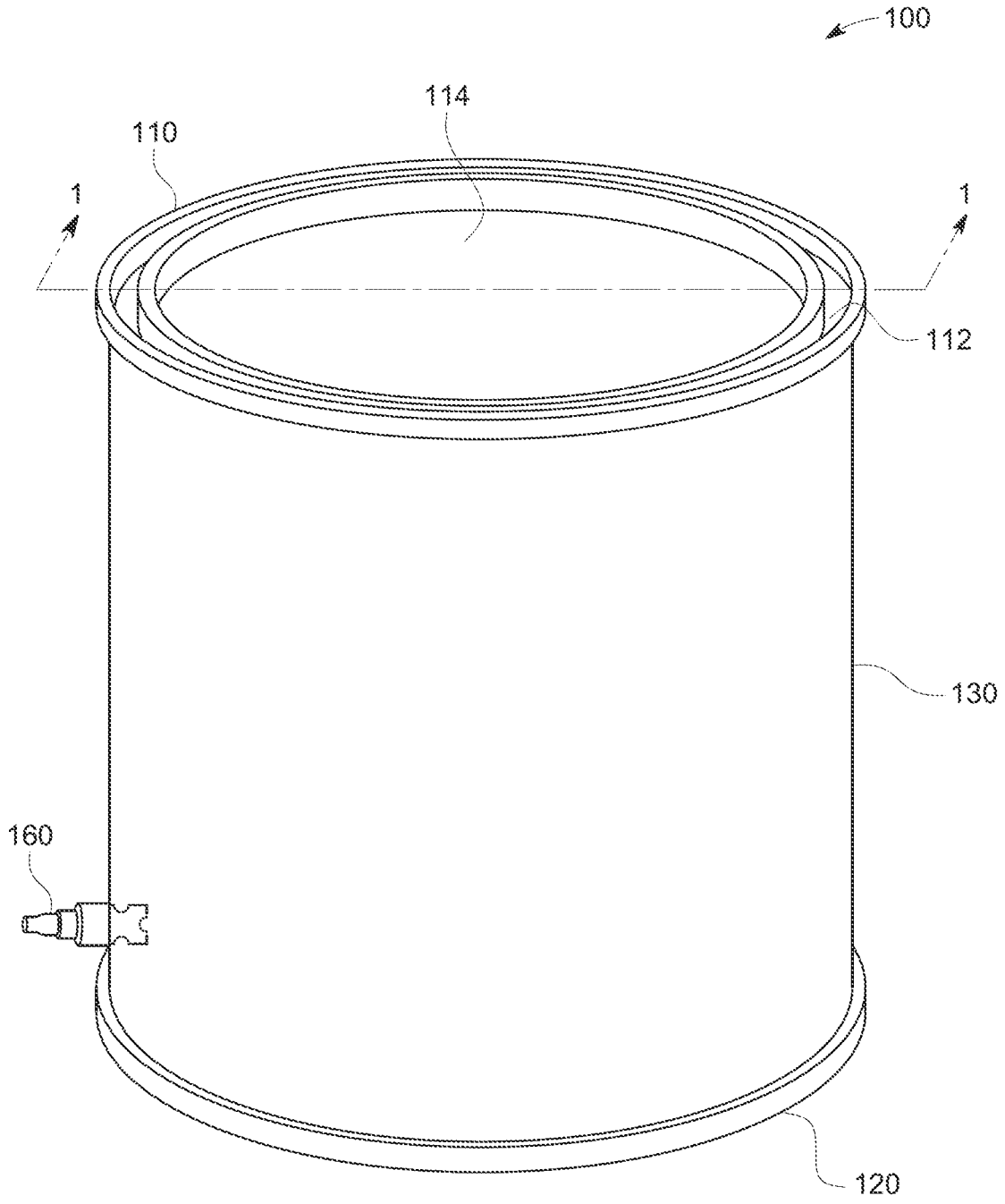
FIG. 1 is a perspective view illustrating a holding receptacle.

In the Summary above and in this Detailed Description, and the claims below, and in the accompanying drawings, reference may be made to particular features of the invention. It may be understood that the disclosure of the invention in this specification includes all possible combinations of such particular features. For example, where a particular feature may be disclosed in the context of a particular aspect or embodiment of the invention, or a particular claim, that feature can also be used, to the extent possible, in combination with and/or in the context of other particular aspects and embodiments of the invention, and in the invention generally.

Where reference may be made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" may be used herein to mean "serving as an example, instance, or illustration." Any aspect described in this document as "exemplary" may not necessarily be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

The present disclosure recognizes the unsolved need for an easy to use, improved, more economical, and effective means of preventing the paint in a paint storage container from degrading due to oxidation and also preventing the paint from drying out. This present disclosure also recognizes that the problem of degradation and drying out in a storage container is not only limited to paint. The present disclosure discloses a holding receptacle with a flexible liner that may be used to store paint. The present disclosure also discloses a holding receptacle with a flexible liner that may be used to store other substances affected by air retention in a holding receptacle. Some examples of other substances that may be affected by air retention include and are not limited to brake fluid and diesel exhaust fluid. The present disclosure provides a way to remove air from the holding receptacle to prevent or minimize oxidation, drying out, or other effects of retained air that can occur in the holding receptacle and increase the shelf of a fill material stored within the holding receptacle.

Figure 2:
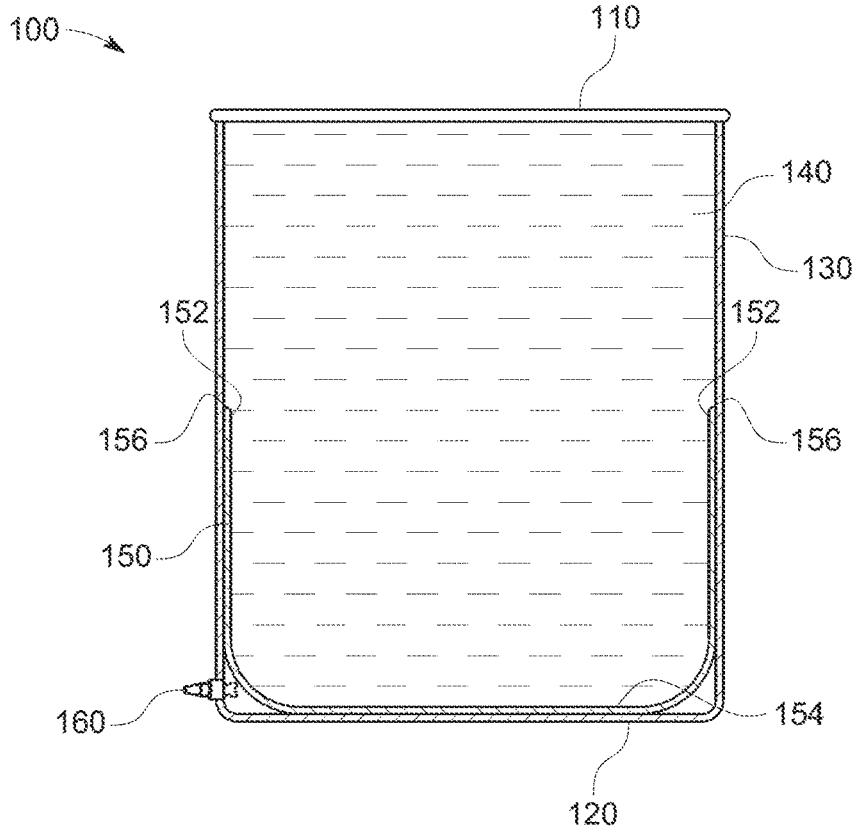
FIG. 2 is a cross sectional view taken along section line 1-1 shown in FIG. 1 of the holding receptacle with a flexible liner containing a full volume of a material within.
Figure 3:
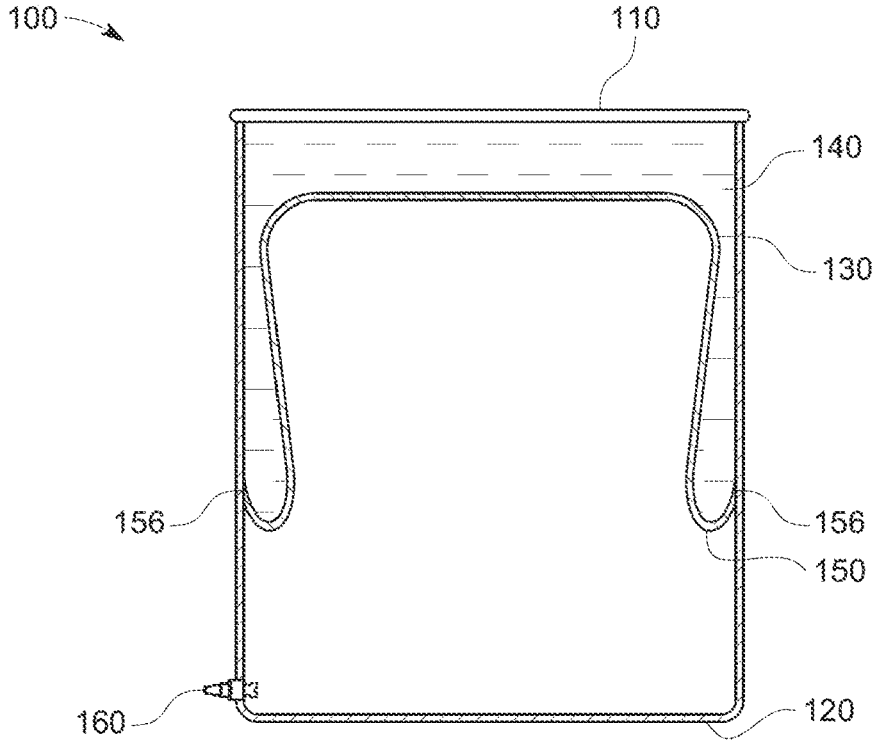
FIG. 3 is a cross sectional view taken along section line 1-1 shown in FIG. 1 of the holding receptacle with a flexible liner that is compressed to reduce accumulated air within an interior volume.

FIGS. 1 through 3 show an improved holding receptacle 100 for retarding oxidation, drying out, or other effects of retained air of substances stored in the holding receptacle 100. FIG. 1 shows a perspective view of the holding receptacle. FIG. 3 illustrates a cross sectional view of the holding receptacle 100 that is relatively full. FIG. 3 illustrates a cross sectional view of the holding receptacle 100 that is partly full.

Referring to FIG. 1, the improved holding receptacle 100 may generally be described as having a body that comprises of an upper end 110, a bottom end 120, and a side wall 130 disposed between the upper end 110 and the bottom end 120. The upper end 110 usually includes an orifice or an opening (not shown in the figures) and the bottom end 120 forms a closed end that together with the side wall 130 form the substance containing structure with an interior compartment 140 (as shown in FIG. 2). The top end may include a rim 112 and a lid 114 that removably closes an opening.

The body of the holding receptacle 100 may be characterized as being made in different sizes and thereby accommodating different volumes of fill material stored within the holding receptacle. Thus, the body of the holding receptacle 100 may be representative of any size commonly used in the storage of paint or other relevant substances stored in storage cans that can benefit from this invention. For example, in the paint or general-purpose receptacle industry, the sizes may include and not be limited to a 0.6 Ounce can, a 1 Gallon can, a 1 Pint can, a 1 Quart can, a 1.5 Gallon can, a 5 Gallon can, a 1.5 Quart can, a 12 Ounce can, and a 16 Ounce can. The body of the holding receptacle 100 may be fashioned out of any material including, but not limited to, plastics, metals, glass, a combination, and any other material known, used, or capable of storing paint and other substances.

As shown in FIG. 2, the holding receptacle 100 is also comprised of a flexible liner 150, an air valve 160, and a lid (as shown in FIG. 1). FIG. 2 illustrates the flexible liner 150 which is placed within the internal compartment 140 and is integrally attached to the body of the holding receptacle 100 at a connection point 156. The flexible liner 150 essentially separates the internal compartment 140 into a section above the connection point 156 which accepts a fill material and a section below the connection point 156 which is a sealed airtight section that accepts air or other gases to compress the flexible liner 150. The flexible liner 150 is firmly connected to the body such that air and any fill material stored within the holding receptacle does not leak through and thus creating the sealed airtight barrier. The flexible liner 150 along with the internal compartment 140 form an interior volume and are provided as the conduit for containing paint or other fill material within the holding receptacle 100. Further, the flexible liner 150 is also provided as the means to move a fill material contained within to move upwards so the level of the fill material may be maintained near the upper end 110 of the body and thus eliminating most of the excess air that tends to occupy an empty space.

The flexible liner 150 may be made out of any material capable of storing paint or other compounds. The flexible liner 150 may be described as having an open end 152 and an enclosed end 154. In a preferred embodiment and as shown in FIG. 2 and FIG. 3, the open end 152 of the flexible liner 150 is integrally attached to an inner surface of the side wall 130 at the connection point 156 and the enclosed end 154 is suspended within the internal compartment 140 and extended toward the bottom end 120 of the holding receptacle 100. In the preferred embodiment as illustrated in FIG. 2 and FIG. 3, the connection point 156 on the inner surface of the side wall 130 may be at a midpoint between the upper end 110 and the bottom end 120. It is to be understood, that the connection point 156 where the flexible liner 150 is integrally attached to the inner surface of the side wall 130 may alternatively be anywhere along the inner surface of the side wall 130 beside the midpoint as mentioned above.

Also illustrated in FIG. 2 and FIG. 3, the holding receptacle 100 also comprises of an air valve 160 wherein the air valve 160 is incorporated into the body of the holding receptacle 100. In a non-limiting preferred embodiment, the air valve 160 is incorporated into the side wall 130 of the body and is located relatively near the bottom end 120 of the holding receptacle 100. The air valve 160 is incorporated such that it traverses through the side wall 130 of the body of the holding receptacle 100 wherein a portion of the air valve 160 lies outside of the body and a portion lies inside of the body in the internal compartment 140. The air valve 160 does not extend into the flexible liner 150, however is situated in the side wall 130 anywhere between the bottom end 120 and the connection point 156 where the flexible liner 150 is integrally attached to the side wall 130.

In the preferred embodiment, the air valve 160 may be any two-way valve design including, but not limited to, gate, globe, plug, ball, butterfly, check, diaphragm, pinch, pressure relief, and control valves. It shall also be introduced that in alternate embodiments, the air valve 160 may be a one-way valve. Additionally, the air valve 160 may be operated via machine, manual work including breath, and any other means of introducing air or other gases into the air valve 160. Finally, while in preferred embodiments shown in FIGS. 2 and 3, the air valve 160 may be located near the bottom end 120 of the holding receptacle 100, the air valve 160 may alternatively be located anywhere else on the body of the holding receptacle 100 as long as the air valve 160 is between the connection point 156 and the bottom end 120.

FIG. 3 shows a perspective view of the holding receptacle 100 partially filled with paint or other fill material and wherein air or other gases have been introduced into the holding receptacle 100 to compress the flexible liner 150 to move upward toward the upper end 110 of the body. Air or other gases are introduced into the internal compartment 140 of the holding receptacle 100 via the air valve 160. As shown in FIG. 3, introducing air or other gas into the flexible liner 150 by the air valve compresses the flexible liner 150 and moves the contents of the flexible liner 150 upward toward the upper end 110 of the holding receptacle 100. As the flexible liner 150 is compressed, a space or void is created and expanded in the internal compartment 140 which is below the connection point 156. The introduction of air or other gases into the internal compartment 140 below the connection point 156 may have the effect of creating a space as the paint or substance containing flexible liner 150 is forced to rise to accommodate the introduction of air or gasses. Where the paint or other fill material being contained within the flexible liner 150 does not occupy an entire volume of the holding receptacle 100, a void between a top level of the paint or fill material and the upper end 110 of the holding receptacle 100 exists. The process of introducing air or other gases through the air valve 160 causes the flexible liner 150 containing paint or other fill material to rise, leading to decreasing the void between the level of the paint or other fill material and the upper end 110 of the holding receptacle 100 and thereby effectively removing excess air from being enclosed with the paint or fill material once the lid is placed over the upper end 110.

Advantageously, the incorporation of the two-way valve 160 into the side wall 130 of the body allows for air or other gases to be both introduced and removed from the internal compartment 140 below the connection point 156 of the flexible liner 150 and inner surface of the side wall 130. The benefit of this includes, but is not limited by, the ability to lower the paint or other substances down from the upper end 110 to provide for mixing the paint or substances which may have been in storage for some time. Additionally, if too much air or gas has been introduced into the internal compartment 140, the two-way valve 160 may allow for the excess air or gas to be removed. Another advantage is where air or gas has been introduced into the internal compartment 140 and the ambient temperature is elevated, thus creating additional pressure within the internal compartment 140. Under this circumstance the two-way valve 160 may be advantageously utilized to remove some, or all, of the air or gas from the internal compartment 140 to effectively reduce the internal pressure from within the body. The foregoing examples are exemplary of some of the advantageous aspects of incorporating a two-way valve 160 into the side wall 130 of the body and are in no way meant to serve as the only beneficial uses of a two-way valve 160.

Advantageously, where the introduction of air or other gases are introduced into the improved holding receptacle 100 and the void between the top level of the paint or other compounds and the holding receptacle's 100 upper end 110 is lessened and an amount of air or other gases contained within that void is eliminated, made negligible, or generally lessened, the degradation of the substances may be eliminated, made negligible, or generally lessened by limiting the amount of oxidation occurring through the interaction between the paint or other compounds and the air or other gases during storage of the paint or other compounds. Additional benefits of removing an amount of air or other gases is that it prevents the paint or other compounds from drying out in its presence within the holding receptacle 100, increases the shelf life of the contained substances, and preserves the overall quality of the contained paint or other compounds.

Additionally, the improved holding receptacle 100 may include a handle (not shown). Such a handle may be, but not limited to, a hingedly attached handle, a rigidly attached handle, or a handle or gripping means molded into the body 110. Alternate embodiments may also include a holding receptacle without a handle. The lid 114, shown in FIG. 1, may also be of any design such as, but not limited to, a pryable disk (a disk that can be pried), a twist off top, a hingedly attached snap top, or a sliding door. The lid 114 is fashioned such as to create an airtight enclosure in the holding receptacle 100 for the storage of paint and any other suitable compound. In use, the lid 114 and the rim 112 of the holding receptacle 100 may be configured such as to create an efficient seal when the lid 114 is placed on the rim 112. It may be important for a user to maintain a clean rim 112 and lid 114 to ensure a proper seal is created by removing any debris and also ensuring proper closure.

Figure 4:
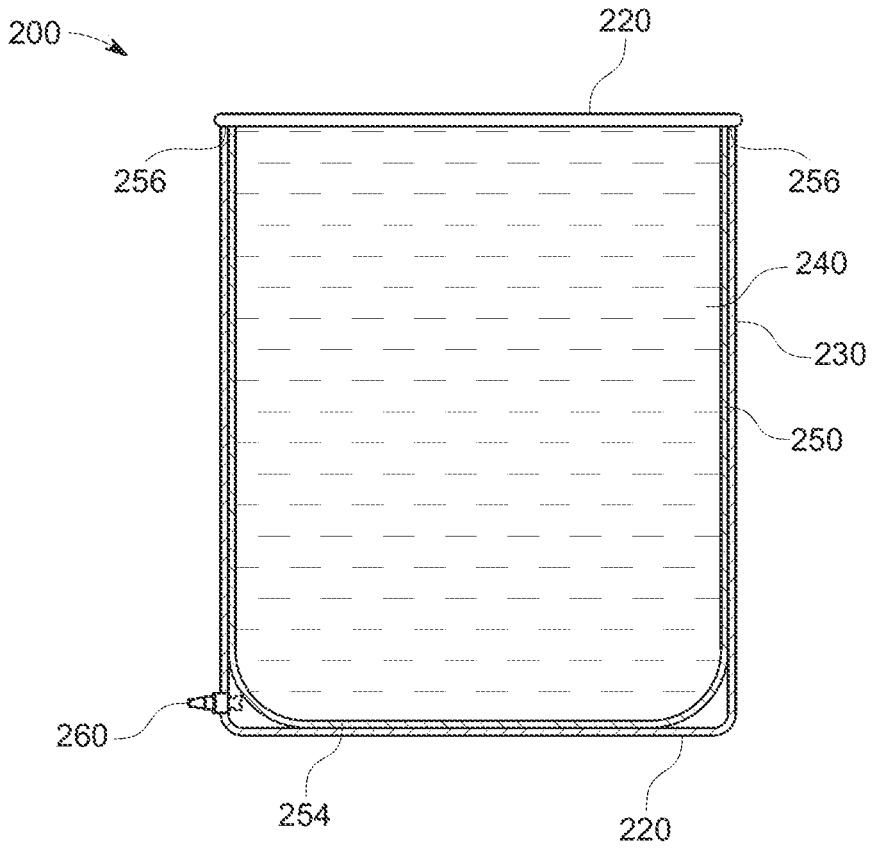
FIG. 4 is a cross sectional view taken along section line 1-1 shown in FIG. 1 illustrating an alternate embodiment of a holding receptacle with a flexible liner integrally connected at a rim.

An alternate non-limiting embodiment of a holding receptacle 200 is shown in FIG. 4. The holding receptacle 200 also comprises of a body having an upper end 210 which is open, a bottom end 220 which is closed, and a side wall 230 which is disposed in between to form an internal compartment 240. The holding receptacle also comprises a flexible liner 250, an air valve 260, and a lid (such as lid 114 in FIG. 1). In this embodiment, the flexible liner 250 may be integrally attached to an inside portion of a rim (such as rim 112 in FIG. 1) at the upper end 210 of the holding receptacle 200. Similar to the above embodiment, an open end (not shown) of the flexible liner 250 is integrally attached to the inside portion of the rim (such as rim 112 in FIG. 1) at the upper end 210 and an enclosed end 254 of the flexible liner 250 is suspended into the internal compartment 240 extending toward the bottom end 220 and remains sitting freely within the confines of the body of the holding receptacle 200. The flexible liner 250 is the receptacle within the internal compartment 240 of the body into which paint, or other substances may be filled. As the illustration shows in FIG. 4, the paint or other fill material sits within the flexible liner 250 and fills it, and no air or other gas is present within the internal compartment 240 of the body; the flexible liner 250 in the fully filled holding receptacle 200 is near the lower end 220 of the body.

Accordingly, the present description provides for various embodiments for an improved holding receptacle utilizing a flexible liner. There are many uses, and advantages offered for the flexible liner as described above in one or more non-limiting embodiments in the present description. Such advantages may, but are not limited to, include reducing the degradation of paint or other substances stored within the can as a result of oxidation, pressurizing, and thus compressing the flexible liner, in order to elevate the paint or substance level or easier access and use, and to remove excess pressure built up within the can due to various reasons such as, but not limited to, being induced by elevated temperatures.

While the holding receptacle 100 has been described to contain paint and other compounds, this should not be construed as limiting as to the types of substances that the holding receptacle 100 may be beneficially utilized. Such additional substances or compounds may include, but not be limited by, all manner of liquids, all manner of solids, and, within preferred embodiments, liquids or other compounds that are prone to drying out when exposed to air, liquids, and/or other compounds whose chemical composition may change by being exposed to air for a prolonged period of time. Examples of such fluids were mentioned above and are not limited to brake fluid and diesel exhaust fluid. The holding receptacle is not limited to a structure described above, but also may be comprised of designs that are suitable to the storage of specific content as long as the compartment is comprised of a flexible liner for the storage of the content and a valve which removes excess air from within the container.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A holding receptacle, comprising:

a body having an upper end, a bottom end, and a side wall, wherein the upper end is open, and the bottom end is closed, such that the side wall is disposed between the upper end and the bottom end, defining an internal compartment;

a flexible liner having an open end and an enclosed end, wherein the open end is permanently sealed to an inner surface of the holding receptacle body to form an airtight seal at a connection point, and wherein the enclosed end of the flexible liner is suspended within the internal compartment extending toward the bottom end of the body such that the flexible liner forms a receptacle within the internal compartment of the body;

an air valve integrated into the body of the holding receptacle, wherein the air valve traverses the side wall such that the air valve partly extends into the internal compartment; and a lid configured to attach to the upper end of the body.

2. The holding receptacle of claim 1, wherein the holding receptacle is configured to move a fill material stored within up to the upper end of the holding receptacle body and remove retained air from the upper end of the holding receptacle body.

3. The holding receptacle of claim 1, wherein the body is made in different sizes so as to accommodate different volumes of fill material.

4. The holding receptacle of claim 1, wherein the flexible liner along with the internal compartment form an interior volume and are provided as the conduit for containing a fill material within the holding receptacle.

5. The holding receptacle of claim 1, wherein the connection point separates the internal compartment of the holding receptacle body, wherein a section above the connection point accepts a fill material and a section below the connection point is a sealed airtight section that accepts air or other gases to compress the flexible liner.

6. The holding receptacle of claim 5, wherein the connection point is relatively at a midpoint between the upper end of the body and the bottom end of the body.

7. The holding receptacle of claim 1, wherein the upper end of the body is configured with a rim.

8. The holding receptable of claim 7, wherein the flexible liner is attached and sealed at the rim instead of integrally attached to the side wall of the body, and the enclosed end of the flexible liner extends into the internal compartment of the body.

9. The holding receptacle of claim 5, wherein the air valve is integrated into the side wall of the body at a point below the connection point of the flexible liner such that the air valve introduces air or other gases into the internal compartment below the connection point to compress the flexible liner toward the upper end of the body.

10. The holding receptacle of claim 1, wherein the air valve is a two-way air valve such that the air valve introduces air or other gases into the internal compartment below the connection point and removes air or other gases from within the internal compartment below the connection point.

11. A holding receptacle for effectively storing paint content in a reduced air environment, comprising:

a body having an upper end, a bottom end, and a side wall, wherein the upper end is open, and the bottom end is closed, such that the side wall is disposed between the upper end and the bottom end to define an internal compartment;

a flexible liner having an open end and an enclosed end, wherein the open end is permanently sealed to an inner surface of the holding receptacle body to form an airtight seal at a connection point, and the enclosed end is suspended within the internal compartment extending toward the bottom end of the body such that the flexible liner along with the internal compartment form an interior volume and are provided as the conduit for containing a fill material;

an air valve integrated into the body of the holding receptacle, wherein the air valve traverses the side wall such that the air valve partly extends into the internal compartment;

a lid configured to attach to the upper end of the body; and wherein the holding receptacle is configured to move the fill material up to the upper end of the holding receptacle body and remove retained air from the upper end of the holding receptacle body.

12. The holding receptacle of claim 11, wherein the body is made in different sizes so as to accommodate different volumes of fill material.

13. The holding receptacle of claim 11, wherein the connection point separates the internal compartment of the holding receptacle body, wherein a section above the connection point accepts a fill material and a section below the connection point is a sealed airtight section that accepts air or other gases to compress the flexible liner.

14. The holding receptacle of claim 11, wherein the connection point is relatively at a midpoint between the upper end and the bottom end of the body.

15. The holding receptacle of claim 11, wherein the upper end of the body is configured with a rim.

16. The holding receptable of claim 15, wherein the flexible liner is attached and sealed at the rim instead of integrally attached to the side wall of the body, and the enclosed end of the flexible liner extends into the internal compartment of the body.

17. The holding receptacle of claim 11, wherein the air valve is integrated into the side wall of the body at a point below the connection point of the flexible liner such that the air valve introduces air or other gases into the internal compartment below the connection point to compress the flexible liner toward the upper end of the body.

18. The holding receptacle of claim 11, wherein the air valve is a two-way valve such that the air valve introduces air or other gases into the internal compartment below the connection point and removes air or other gases from within the internal compartment below the connection point.

* * * * *